United States Patent [19]

Ory

[11] Patent Number: 4,476,957

[45] Date of Patent: Oct. 16, 1984

[54] UNITARY WINDOW SAFETY BARS AND EXTERIOR FIRE ESCAPE LADDER

[76] Inventor: Harry J. Ory, 2812 Painter St., New Orleans, La. 70122

[21] Appl. No.: 556,729

[22] Filed: Nov. 30, 1983

[51] Int. Cl.[3] ..... E06C 9/10

[52] U.S. Cl. ..... 182/21; 182/97; 182/195

[58] Field of Search ..... 182/21, 20, 195, 97

[56] References Cited

U.S. PATENT DOCUMENTS

| | | | |
|---|---|---|---|
| 43,283 | 6/1864 | Ballentine | 182/21 |
| 145,844 | 12/1873 | Chipley | 182/21 |
| 269,377 | 12/1882 | Bessier | 182/21 |
| 573,165 | 12/1896 | Scherrer | 182/21 |
| 743,199 | 11/1903 | Scherrer | 182/94 |
| 956,183 | 4/1910 | Scherrer | 182/21 |
| 987,494 | 3/1911 | Scherrer | 182/94 |
| 1,072,024 | 9/1913 | Momo | 182/21 |
| 1,629,541 | 5/1927 | Scholer | 182/21 |
| 3,259,207 | 7/1966 | Schoefler | 182/96 |
| 4,232,761 | 11/1980 | Phillips | 182/195 |

*Primary Examiner*—Reinaldo P. Machado
*Attorney, Agent, or Firm*—James B. Lake, Jr.

[57] ABSTRACT

A pair of frames are slidably interfitted on a common slide axis. Safety bars placed normal to the slide axis and alternately opposite sides of the slide axis, are fixed in the frames in sliding noninterference and for halving space between bars when frames are slidably coincident. Frames are pivotally fixed in the lintel or upper half of a building window casing for pivoting outwardly. A locking device, mounted in a window casing and controllable by anyone in the building and remote from the casing, locks the frames slidably and pivotally coincident in the casing as closely spaced window safety bars, and similarly unlocks the frames to pivot them outwardly clear of the window sill for slidable extension downwardly as an exterior fire escape ladder with double spaced rungs and angled handrails for standing entry on the ladder from the window sill. Bar stops fixed to opposite ends of the respective frames prevent separation of the slidably interfitting frames.

9 Claims, 10 Drawing Figures

UNITARY WINDOW SAFETY BARS AND EXTERIOR FIRE ESCAPE LADDER

BACKGROUND OF THE INVENTION

The invention generally relates to window safety bars and fire escapes, and more particularly to a unitary window safety bars and exterior fire escape ladder, and in which there is no loss of effectiveness of purpose and use in either category due to the other.

The prior art teaches combinations with similar purposes to put in building window casings, but in which the effectiveness of each part of the combination is reduced by the other both in purpose and use. Thus the effectiveness of purpose of the window safety bars is reduced when anyone outside a building can release the window safety bars in the window casings thereof, and the effectiveness of the exterior fire escape ladder is reduced when everyone inside the building cannot release the window safety bars. The effectiveness in use of said combinations as a fire escape ladder is reduced when access thereto is physically dangerous and difficult for the elderly, infirm, sedentary, and women, the last because of the type of clothing normally worn.

In the following references, Scholer, U.S. Pat. No. 1,629,541 teaches a safety metal grill that is locked in place and can only be used as a fire escape when the possessor of the key for the lock is present. Also the grill is pivoted to a window sill for swinging outwardly and downwardly therefrom as a fire escape ladder and thereby requiring a user to crawl out on the sill and half hanging thereover to reach backward with a foot to find a ladder rung.

Momo, U.S. Pat. No. 1,072,624 teaches a window railing lattice extendable downwardly from just above a window sill or swung outwardly therefrom for poor access.

Scherrer, U.S. Pat. No. 956,183 and 573,165 teach swinging casements with difficult access similar to Momo and requiring a 90° turn with one backward handhole.

Bessier, U.S. Pat. No. 269,377 and Chipley, U.S. Pat. No. 145,844 also teach swinging fire escape ladders, all except Chipley swinging normal to a window casing, and Chipley teaching shutters swinging 180° thereto, all posing risk of falling to gain access.

The invention teaches a unitary window safety bars and fire escape ladder for either use by anyone inside the window of a building in which it is installed. As an exterior fire escape ladder, easy access for a person within the building is provided from a standing position on a window sill facing forward and holding with both hands to horizontal side supports by taking a short step forward to a vertical ladder cantilevered outwardly from the building and descending between building and ladder to similar ladders in lower windows until the ground is reached, an escape well within the abilities of all ambulatory persons.

A second embodiment of the invention for a one story building only teaches the same spacing between safety bars and ladder rungs and backward access from standing position on a window sill with angled frame sides providing handrails and descent facing the building to the ground as in using a leaning conventional ladder.

SUMMARY OF THE INVENTION

It is an object of the invention to provide a unitary window safety bars and exterior fire escape ladder in which the dual uses and purposes are not adversely affected by the unitary apparatus.

Another object of the invention is to provide a unitary window safety bars and exterior fire escape ladder which is usable by the elderly, infirm, sedentary, and women normally clothed.

Yet another object of the invention is to provide for one story buildings a unitary window safety bars and exterior fire escape ladder that is simpler and more economical to make and install than the embodiment for installation and use in multi-storied buildings.

DETAILED DESCRIPTION OF THE PREFERRED EMBODIMENTS

Figure 1:
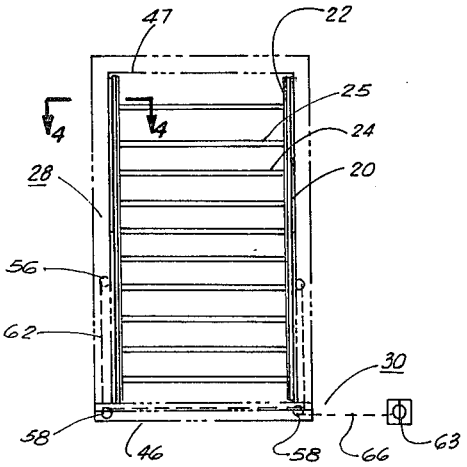
FIG. 1 is a front view of the invention mounted as window safety bars in a building window casing.

Referring to FIGS. 1–6, the invention comprises a pair of slidably interfitting outer and inner frames 20 and 22, each having a plurality of horizontal bars 24 and 25 respectively fixed therein spaced equally and vertically apart. A pair of side supports 26 pivotally mounts said frames, when slidably coincident, in a window casing 28 as window safety bars. A locking device 30 is operably mounted in the sides and sill of said window casing, and is operable only from inside said window casing to lock and unlock side supports 26 for pivoting said frames in and out of said window casing for extended use as an exterior fire escape ladder.

Referring particularly to FIGS. 2–5, outer frame 20 comprises elongated sides 21 made from angle stock, "L" shaped in cross-section (see FIG. 4), and extending along the sides of window casing 28 from sill 46 to lintel 47 and oppositely disposed for long side of the "Ls" to be transverse the plane of said window casing and the short side of the "Ls" to be parallel with said plane. Horizontal safety bars 24 are fixed in the long side of the "L" of the frame sides 21 extending therebetween, and a stop bar 52 is fixed between said short side of the "Ls" adjacent the sill 46 ends of said frame 20 for engaging an associated stop bar 50 of inner frame 22 as will be explained hereafter.

Inner frame 22 comprises elongated sides 23 made from channel stock, "U" shaped but with a flat base in cross-section (see FIG. 4), and extending from sill to lintel of said window casing similarly disposed to slidably engage outer frame sides 23 "L" shaped in cross-section with the flat base of the "U's" to said short side of the "L's" and opposing sides of the "U's" to opposite long sides of the "L's". Horizontal safety bars 25, shorter than safety bars 24, are fixed in the unengaged sides of the "U" of the frame 22 sides 23 and extending therebetween. A stop bar 50 is fixed to the flat bases of the "U's" adjacent the lintel end of sides 22 and adapted to engage said stop bar 52 of the outer frame 20 to prevent separation of said inner and outer frames when slidably extending downwardly. Said inner frame is slidably insertable in said outer frame from the lintel end as shown in FIG. 4 and is retainable therein by said outer frame and stop bars 50 and 52.

Figure 4:
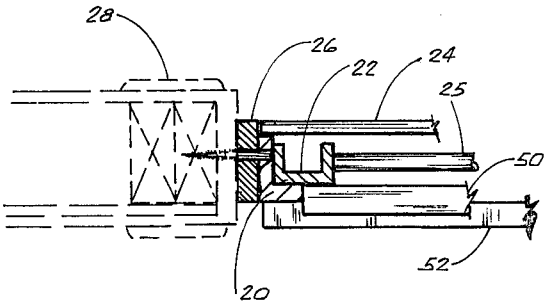
FIG. 4 is a cross-sectional view taken along section line 4—4 of FIG. 1.
Figure 3:
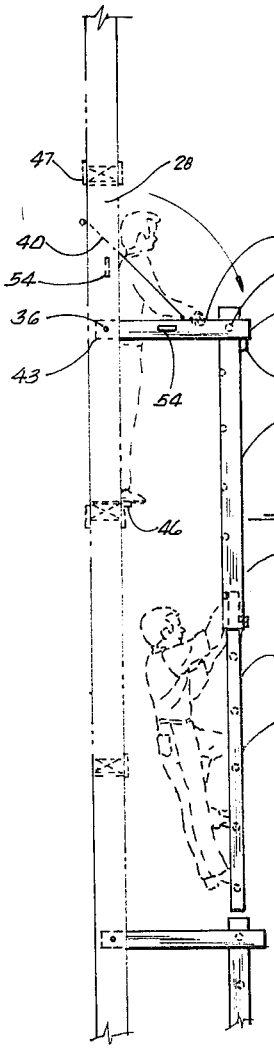
FIG. 3 is a side elevation of the invention as shown in FIG. 2.
Figure 5:
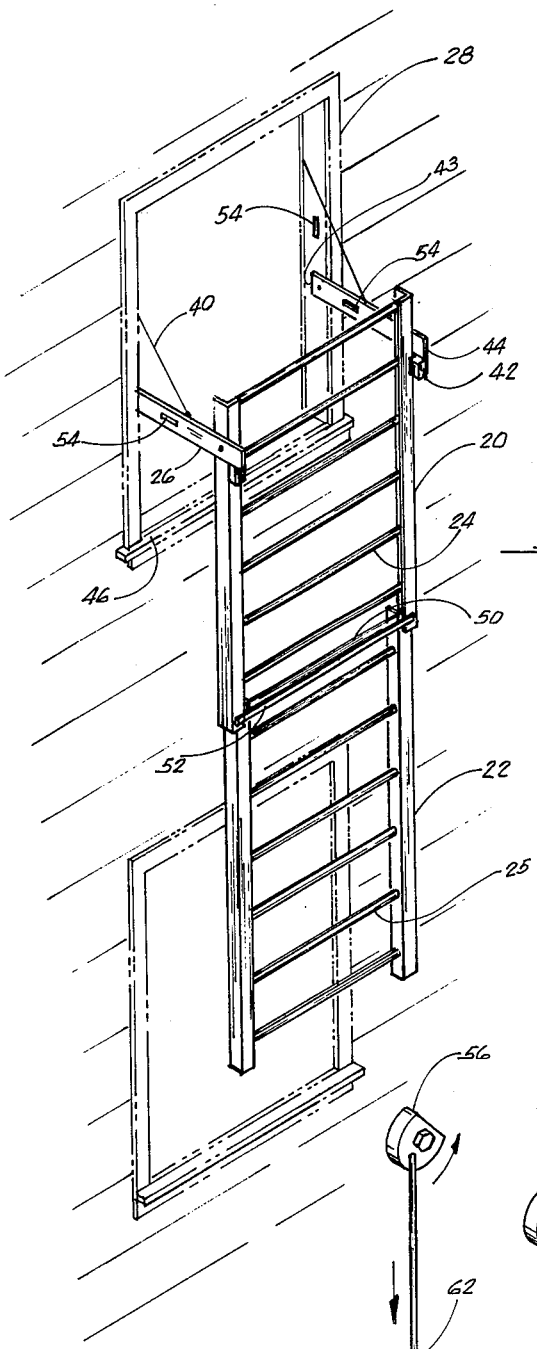
FIG. 5 is a three dimensional view of the invention as shown in FIG. 3.

Referring to FIGS. 3–5, side supports 26 comprise a pair of flat bars having oppositely disposed ends 43 and 44 with transverse pivot holes 38 defined in each said end and locking slots 54 defined therebetween. Stops 42 are fixed below respective ends 44 and outboard of pivot holes 38. The side supports are pivoted to outer frame 20 by pivots 36 through pivot holes 38 in ends 44 and adjacent the frame's lintel end. Oppositely disposed support ends 43 are respectively pivoted to window casing sides 21 below the casing lintel a distance equal to that from support end 44 to lower pivot hole 38. A cable stop 40 is fixed to each support 26 intermediate its ends 43 and 44 and to each window casing side between the supports' fixed ends and lintel 47. In use stops 42 restrict the pivoting on outer frame 20 on said supports to 90°, and cable stops 40 restrict the pivoting of said supports to 90° to the window casing.

Figure 6:
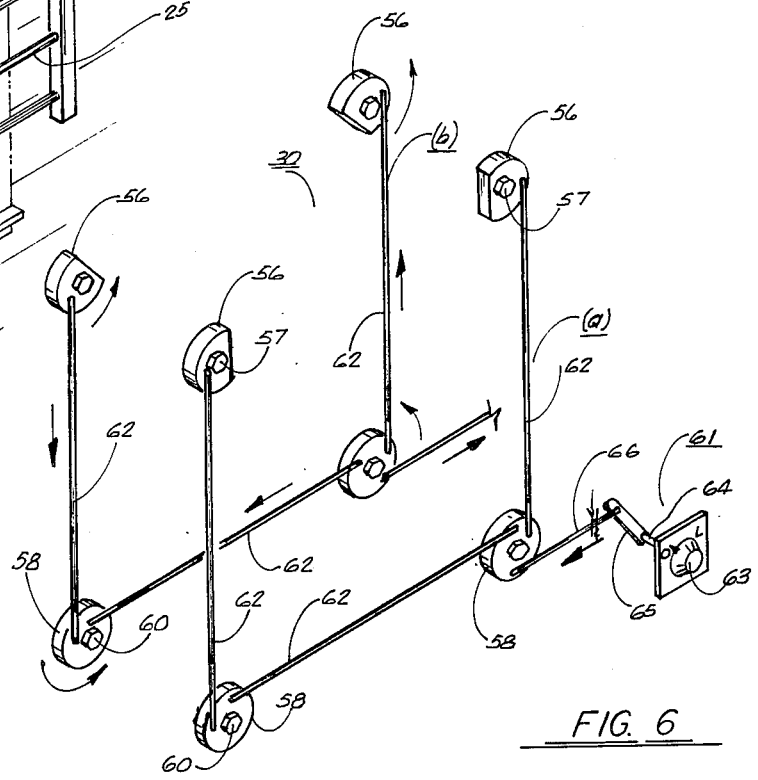
FIG. 6 (*a*) and (*b*) are three dimensional enlarged views of the locking device of FIG. 1 shown (*a*) unlocked, and (*b*) locked.
Figure 7:
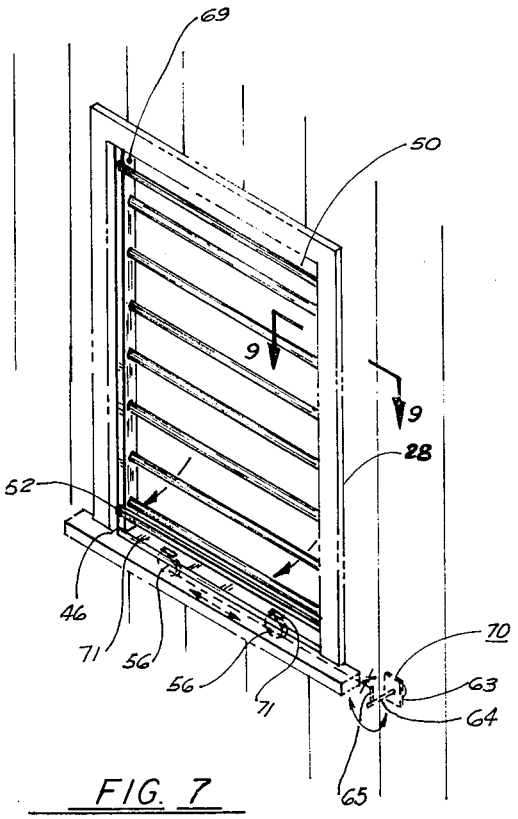
FIG. 7 is a three dimensional view of a second embodiment of the invention mounted as window safety bars in a partially shown one story building.
Figure 8:
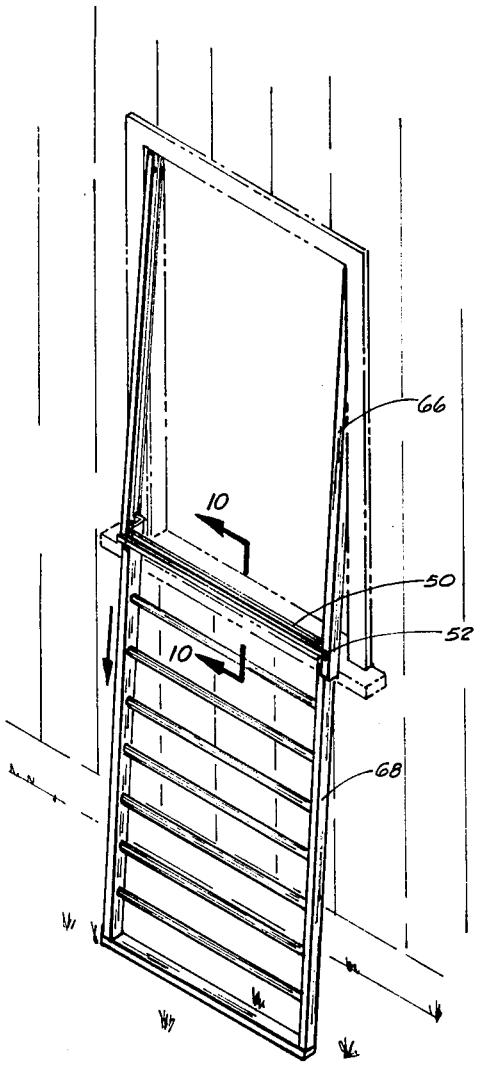
FIG. 8 shows the matter of FIG. 7 adjusted as an exterior fire escape ladder.
Figure 10:
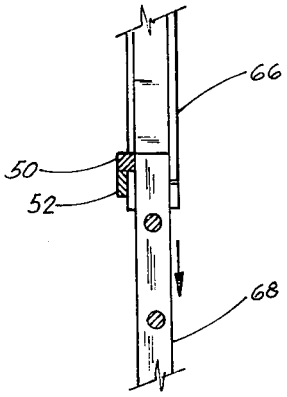
FIG. 10 is a cross-sectional view taken along section lines 10—10 of FIG. 8.
Figure 9:
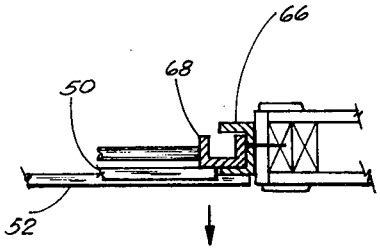
FIG. 9 is a cross-sectional view taken along section line 9—9 of FIG. 7.

Referring to FIGS. 1, 5 and 6, locking device 30 comprises locking slots 54 defined in said window casing sides between the pivoted ends 43 of side supports 26 and cable stops 40 ends fixed to sides of window casing 28, and in alignment with locking slots 54 defined in said side supports when said supports are pivoted into said window casing. Cylinder segments 56 are respectively mounted for rotation on parallel axes 57 with flat portions of said segments respectively flush with respective locking slots 54 defined therein and rotatable to extend partially therethrough. Cylindrical members 58 are respectively mounted for rotation on parallel axes 60 in said casing sill 46 vertically below and in the same plane as cylinder segments 56 and axes 56 and 57. A pair of rods 62 respectively connect oppositely disposed horizontal radial extremities of respective vertically aligned cylinder segments with the same radial extremities of associated cylindrical members, and a similar rod 62 connects upper radial extremities of said cylindrical members. Another rod 66 connects a lower radial extremity of a cylindrical member 58 and a manual crank mechanism 61 mounted in a building wall adjacent said window casing and adapted to rotate the cylindrical member a quarter turn counterclockwise thereby rotating the other cylindrical member and both the connected cylinder segments on their respective parallel axes and in the same plane in alignment for said segments to project through said slots 54 in said casing and side support to lock the side support and frames 20 and 22 in the window casing. A quarter turn of said cylindrical member clockwise unlocks said frames from the casing (see FIG. 6 (*a*) and (*b*)). The manual crank mechanism is mounted out of reach of anyone outside the window casing and comprises a dial crank 63 fixed on the outboard end of a shaft 64 parallel to axes 57 and 60 of the rotatable members and segments 56 and 58. A lever 65 is fixed by an end normal to said shaft and in the plane of members 58. The free end of said lever 65 is connected to said rod 66 free end, whereby turning or rotating said dial crank 63 clockwise rotates said members counterclockwise, and rotating said dial crank counterclockwise rotates said members clockwise.

A second embodiment of the invention (see FIGS. 7–10) also comprises a pair of slidably interfitting frames as in the first embodiment except that an outer frame 66 is channel shaped but larger than inner frame 68 which is similar to the inner frame of FIG. 4. The change was made necessary by the absence of safety bars 24 in the outer frame for holding the inner frame 68 in operable association therewith. Side supports 26 of the first embodiment are omitted and the outer frame 66 is pivoted to window casing sides adjacent said casing lintel. In the locking device 30 of the first embodiment, the cylindrical members 58 and window casing slots 54 are omitted to provide a locking device 70 having a manual crank mechanism 61 identical with that of the first embodiment that rotate cylinder segments 56 directly to project through locking slots 71 defined in the sill of window and outer frame in alignment, said segments being mounted in the window sill.

Figure 2:
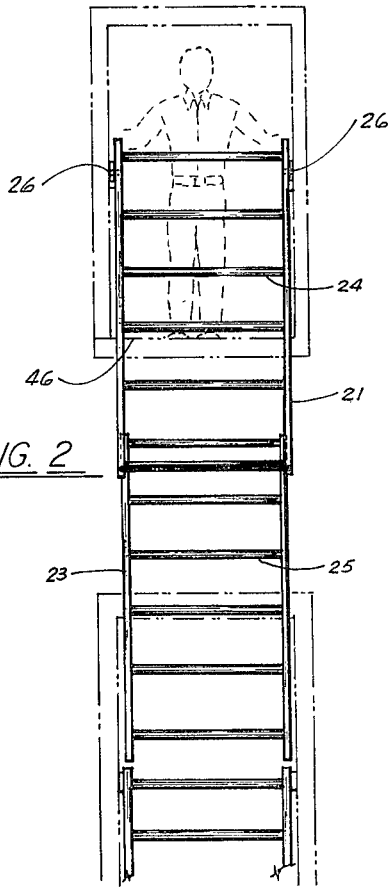
FIG. 2 is a front view of the invention pivotally and slidably adjusted as an exterior fire escape ladder.

With the first embodiment locked as window safety bars in a window casing, to adjust as an exterior fire escape ladder, anyone inside the building rotates the dial crank 63 to unlock the locking device 30 and release side supports 26 from the window casing sides. A push against the upper part of the frames 20 and 22 pivots side supports 26 outward and downward 90°, as limited by cable stop 40. Frames 20 and 22 are carried free of window sill 46 allowing the inner frame 22 to extend slidably downward by gravity until stops 50 and 52 engage to prevent separation of the frames. A person exiting the building steps on the window sill, grasps the side supports with respective hands and steps forward on to a horizontal bar now a ladder rung 24, shifting his hands to grasp the frame sides 21. The frames are prevented from swinging out around outboard pivots 38 more than normal to the side supports. The person descends supported vertically between the building and the ladder to a similar lower ladder and/or the ground, as shown in FIGS. 2 and 3. To adjust back to window bars, a person inside the building reaches out of the window grasping the frame sides 21 and lifting them upward, pivoting the side supports upwardly and inwardly until frame 22 contacts the window sill. The grasps are shifted to frame sides 23 of bars 25 and the inner frame slidably raised into coincidence with outer frame 20 and both pulled inwardly by bars 24 and 25 into the window casing 28. The person then steps to the dial crank and rotates it to lock the side supports which have also pivoted upward and inward into the window frame with the frames into the window casing.

With the second embodiment locked as window safety bars in a window casing, to adjust as an exterior fire escape ladder to the ground, anyone inside the building rotates the dial crank 63 of the locking device 30 to unlock locking device 70 and release the frames from the window sill. A push against the bottom of the frames 66 and 68 pivots them outwardly around pivots 69 adjacent the top of the frames and lintel of the window casing, clear of the window sill. Inner frame 68 slides downward until prevented from sliding out of frame 66 by stops 50 and 52 or by the ground. A person leaving the building stands facing inward on the window sill and grasping the angled sides of frame 66 steps on the horizontal bars 25 of the inner frame and descends as on a leaning straight ladder. To adjust back to window bars, the inner frame can be raised either from inside or outside the building and both frames seated in the window casing. However, the frames can only be locked in the casing by a person inside stepping to the dial crank 63, out of reach from the window, and turning it to lock the frames to the window sill.

What is claimed is:

1. A unitary window safety window bars and exterior fire escape ladder comprising:

(a) inner and outer frame means slidably interfitting along a common slide axis and adapted to fit, when slidably coincident, in a window casing, having sides, sill and lintel, of a building wall;

(b) a plurality of bars transversely fixed in at least the inner of said frame means and equally spaced apart along said slide axis for dual use as safety bars and ladder rungs;

(c) frame mounting means for pivotally securing said frame means to said window casing sides adjacent the lintel and to provide handrails for ladder use; and (d) locking means mounted in said window casing and building wall for inside locking anyone of said frame means and bars in coincidence and to said window casing as window safety bars, and for unlocking said coincident frame means and bars from said window casing and for outwardly pivoting said coincident frame means and bars outwardly clear of the window sill and slidably downward as an exterior fire escape ladder, easily and safely enterable from standing position on said sill by grasping said handrails; and (e) stop bar means, mounted on said inner frame means upper end and on said outer frame means lower end, adapted to engage for the prevention of downwardly sliding separation of said frame means.

2. A unitary window safety bars and exterior fire escape ladder comprising:

(a) inner and outer frame means slidably interfitting along a common slide plane and adapted to fit, when slidably coincident in a building wall window casing having vertical sides and horizontal sill and lintel;

(b) a plurality of bars horizontally fixed and spaced vertically apart in said inner and outer frame means and alternately on opposite sides of said slide plane for eliminating slide interference and halving vertical spacing between successive horizontal bars when said frame means are slidably coincident;

(c) frame mounting means for pivotally securing said said inner and outer frame means to said window casing sides adjacent said lintel, and to provide handrails for security when stepping from said sill;

(d) locking device means mounted in said window casing sides and sill and building wall for inside locking by anyone of said coincident frame means and bars in said window casing as window safety bars, and for unlocking said coincident frame means and bars from said window casing to pivot them outwardly clear of said sill and downwardly with said inner frame means sliding in downward extension of said outer frame means as an exterior fire escape ladder, safely entered upon from a forward facing standing sill posizion with use of said handrails; and (e) stopping means for limiting the pivoting and sliding of said of said inner and outer frame means.

3. Unitary window safety bars and exterior fire escape ladder as described in claim 2 wherein said inner and outer frame means comprise:

(a) an outer frame having sides "L" shaped in cross-section with angle sides and bases defining respective right angles therebetween, and oppositely arranged with angle bases aligned in a plane parallel to that of the window casing for slidably interfitting between said frame and angle sides inner frame sides defining respective right angles;

(b) an inner frame having sides, "U" shaped in cross-section with channel sides and flat bases of each frame side defining opposed right angles therebetween for slidably interfitting a channel side and base of the two of each said channel frame in each of said frame sides with angle side an base of said outer frame to retain said frames transversely and forwardly in slidable engagement; and (c) bar stop means mounted transversely across the sill ends of said outer frame sides angle bases, and across the lintel ends of said inner frame sides flat bases in a common vertical plane for intersecting to prevent downwardly sliding separation of said frames.

4. Unitary window safety bars and exterior fire escape ladder as described in claim 2 wherein said plurality of bars comprise:

(a) longer bars fixed in said outer frame than in said inner frame to extend beyond and to the rear of said inner frame for preventing rearward separation of said slidably interfitting inner and outer frames.

5. Unitary window safety bars and exterior fire escape ladder as described in claim 2 wherein said frame mounting means comprise:

(a) a pair of elongated rigid side support, each having oppositely disposed ends defining respective transverse pivot holes, said supports being pivoted to respective outer frame sides adjacent the lintel ends thereof and window casing sides a support length down from the lintel by pivots through said respective pivot holes and coinciding pivot holes defined in the respective sides of said outer frame and window casing for pivotally cantilevering said frames outwardly and downwardly a step beyong said building for passage down and between said ladder and building;

(c) stop means fixed to and below the frame ends of said side supports for limiting pivoting of said frame means to normal to said side supports, and fixed flexibly to said side supports intermediate the oppositely disposed ends thereof and window casing sides between casing pivoted end of said support and the lintel end of said casing for limiting pivoting of said support to normal to said window casing.

6. Unitary window safety bars and exterior fire escape ladder as described in claim 2 wherein said locking device means comprises:

(a) aligned slots defined in respective casing sides and frame mounting means when coincident;

(b) cylinder segments, having flat portions, mounted for rotation on parallel axes with said flat portions flush in said casing slots;

(c) cylindrical members respectively mounted for rotation in said casing sill vertically below said cylinder segments on parallel axes;

(d) rigid rods respectively connect oppositely disposed horizontal radial extremities of said cylinder segments with respective vertically aligned cylindrical members similar radial extremities, and the upper radial extremities of one cylinder member with the other; and (e) manual crank mechanism mounted for rotation in said building wall and out of arm reach of said window casing and connected in alignment with one said cylindrical member for rotating it and connected member and segments a quarter turn to project opposite ends of said segment flat portion through said frame mounting means coincident slot, thereby locking said coincident frames in said widdow casing.

7. Unitary window safety bars and exterior fire escape ladder comprising:

(a) inner and outer frame means slidably interfitting along a common slide axis and adapted to fit, when slidably coincident in a one story building wall window casing having vertical sides and horizontal sill and lintel;

(b) a plurality of bars horizontally fixed and spaced vertically apart in said inner frame means (c) pivot pins for pivoting said outer frame to said window casing adjacent the lintel thereof, the frame sides acting as angled handrails for stepping from casing sill to ladder;

(d) Locking device means mounted in said sill and building wall for inside locking by anyone of said coincident frame means and bars, and for unlocking said coincident frame means and bars from said window casing to pivot them outwardly clear of said sill and downwardly with said inner frame means sliding in downward extension of said outer frame means as an exterior fire escape ladder, safely entered upon from a rear facing standing position with use of said angled outer frame as handrails.

8. Unitary window safety bars and exterior fire escape ladder as described in claim 7 wherein said inner and outer frame means comprise:

(a) inner and outer frames having sides, "U" shaped in cross-section with channel sides and flat bases of each frame defining right angles therebetween for slidably interfitting with channel sides and flat bases normal in side to base engagement of interfitting frame sides;

(b) bar stop means mounted transversely across the sill ends of said outer frame sides channel sides, and across the lintel ends of said inner frame sides channel flat bases in a common vertical plane for intersecting to prevent downwardly sliding separation of said frames.

9. Unitary window safety bars and exterior fire escape ladder as described in claim 7 wherein said locking device means comprise:

(a) aligned slots defined in the casing and frame sills with frames coincident in said casing;

(b) cylinder segments, having flat portions, mounted for rotation on parallel axes transverse said casing sill with flat portions flush with said sill slots (c) a rigid rod connecting the upper radial extremities of said segments; and (d) manual crank mechanism mounted for rotation in said building wall and out of arm reach of said window casing and connected in alignment with one said segment for rotating it and connected segment a quarter turn to project ends of said segments flat portions through said coincident slots and thereby locking said coincident frames in said window casing.

* * * * *